US007628225B2

(12) United States Patent
Petersson et al.

(10) Patent No.: US 7,628,225 B2
(45) Date of Patent: Dec. 8, 2009

(54) DRILLING DEVICE

(75) Inventors: Inge Petersson, Torslanda (SE); Robert Ludwigson, Göteborg (SE)

(73) Assignee: GVA Consultants AB, Gothenburg (SE)

( * ) Notice: Subject to any disclaimer, the term of this patent is extended or adjusted under 35 U.S.C. 154(b) by 0 days.

(21) Appl. No.: 12/060,727

(22) Filed: Apr. 1, 2008

(65) Prior Publication Data

US 2009/0057011 A1 Mar. 5, 2009

(30) Foreign Application Priority Data

Apr. 2, 2007 (SE) ..... 0700835

(51) Int. Cl.
*E21B 15/02* (2006.01)

(52) U.S. Cl. ..... 175/5; 175/52; 175/85; 166/77.51; 166/341

(58) Field of Classification Search ..... 175/5, 175/52, 85; 166/77.51, 79.1, 341, 358; 414/22.51, 414/22.62, 22.68
See application file for complete search history.

(56) References Cited

U.S. PATENT DOCUMENTS 3,333,562 A * 8/1967 Deal, Jr. et al. ..... 114/264
3,718,266 A * 2/1973 Donnally ..... 414/22.71
3,895,677 A * 7/1975 Bokenkamp ..... 166/359
3,981,369 A * 9/1976 Bokenkamp ..... 175/5
4,007,782 A * 2/1977 Nybo et al. ..... 166/79.1
4,108,318 A * 8/1978 Rode et al. ..... 414/22.51
4,351,398 A * 9/1982 Prins et al. ..... 173/104
4,367,796 A * 1/1983 Bolding ..... 166/341
4,899,682 A * 2/1990 Pouget et al. ..... 114/264
5,647,443 A * 7/1997 Broeder ..... 175/5
6,032,929 A 3/2000 Vatne
6,056,071 A 5/2000 Scott
6,217,258 B1 * 4/2001 Yamamoto et al. ..... 405/201
6,361,262 B1 * 3/2002 Roodenburg ..... 414/22.51
6,585,455 B1 * 7/2003 Petersen et al. ..... 405/224.4
6,766,860 B2 * 7/2004 Archibald et al. ..... 166/341
6,902,007 B1 * 6/2005 Orr et al. ..... 166/379
6,926,488 B1 * 8/2005 Bolding et al. ..... 414/22.62
6,955,223 B2 * 10/2005 Orr et al. ..... 166/378
7,021,402 B2 * 4/2006 Beato et al. ..... 175/7

(Continued)

OTHER PUBLICATIONS

Anonymous third party submission in corresponding Sweedish Patent Application No. SE 0700835-2. (3 pages).

*Primary Examiner*—Thomas A Beach
*Assistant Examiner*—Matthew R Buck
(74) *Attorney, Agent, or Firm*—GVA Consultants AB; Kellogg Brown & Root LLC

(57) ABSTRACT

The present embodiments relate to systems for building and/or handling a tubular string of a drilling device. The drilling device comprises a drill floor and a drilling derrick extending from the drill floor. The drill floor has an extension in a first plane (P1) being substantially perpendicular to a first direction (N). The system comprises a suspension device being fixedly attached to the drilling derrick, wherein a projection of the suspension device, in the first direction, onto the first plane (P1), is situated outside the drill floor. The present embodiments also relate to drilling device trolleys arranged to transport a component to and from a drilling center of a drilling device. The present embodiments relate to a use of a drilling device having a drill floor, wherein the drilling device has a suspension device being situated outside the drill floor.

15 Claims, 9 Drawing Sheets

U.S. PATENT DOCUMENTS 7,086,474 B1 * 8/2006 Trevithick et al. ..... 166/379
2002/0166698 A1 * 11/2002 Beato et al. ..... 175/7
2007/0251725 A1 * 11/2007 Banks ..... 175/5

* cited by examiner

DRILLING DEVICE

CROSS REFERENCE TO RELATED APPLICATIONS

This application claims priority to Swedish Patent Application 0700835-2, filed with the Swedish Patent Office on Apr. 2, 2007, the entirety of which is incorporated by reference herein.

BACKGROUND

1. Field

The present embodiments elates to a system for building and/or handling a tubular string of a drilling device. The drilling device comprises a drill floor and a drilling derrick extending from the drill floor. The drill floor has an extension in a first plane being substantially perpendicular to a first direction. The system comprises a suspension device being fixedly attached to the drilling derrick, wherein a projection of the suspension device, in the first direction, onto the first plane is situated outside the drill floor.

The present embodiments also relate to a drilling device trolley arranged to transport a component to and from a drilling centre of a drilling device. Further, the present invention relates to a use of a drilling device having a drill floor, wherein the drilling device has a suspension device being situated outside the drill floor. Moreover, the present invention relates to a method of adding a tubular member to a tubular string.

2. Description of the Related Art

When drilling in the earth crust, e.g. drilling for natural resources in the form of hydrocarbons like natural gas or oil, it is preferred to achieve rapid and safe drilling. Especially when drilling for hydrocarbons off-shore there are high demands for safety, as leakage of for example oil into the sea could have serious consequences. To improve safety when drilling for hydrocarbons, especially when drilling off-shore, a plurality of systems are used today. Drilling is for example often performed by conveying a drill string through a riser, which riser extends from the drilling device, often being situated at the water surface, down to the bottom.

Moreover, drilling below the bottom often occurs through a blow-out preventer, which on one hand can protect the rest of the drilling equipment against pressure spikes which might occur when a gas pocket with high pressure is encountered during drilling, and on the other hand can be arranged to seal the drilling well if the drilling device, which may be situated on a floating structure, for some reason is drifting away from its drilling position. Further, when the drilling of a well has been finished, a valve system—which is often called "Xmas Tree"—is not seldom attached to the drilling hole, to which valve system conduits may be coupled to lead hydrocarbons to one or more production plants. Both the blow-off preventer and the valve system can be attached to the opening at the bottom of the sea and in these cases the component, i.e. either the blow-out preventer or the valve system, is brought down to the bottom by attaching the component to a tubular string at the drilling device, where the length of the string is successively increased, by connecting tubes to each other at the drilling device, until the component has reached the bottom.

From the abovementioned examples, it is realized that, besides the construction of the tubular string itself, a drilling device, especially a drilling device off-shore, is traditionally used to build and/or handle tubular strings, whose purpose is not directly to perform the drilling itself. Since traditional drilling devices often only have one system for building and/or handling tubular strings, comprising a hang-off device for pipes and a rotary table for rotating and/or holding the tubular string, this has led to that the drilling of an oil well taking long time.

To solve this problem, prior art, e.g. EP 0836 668, suggests that a drilling device of a vessel is provided with two systems, each one comprising a suspension device and a rotary table, for building and/or handling tubular strings. Further, EP 0 836 668 discloses that the drilling device can be provided with means for moving tubular strings between the systems. In this way, parallel activities can be performed by the drilling device, which speeds up the total drilling process. The drilling device according to EP 0 836 668 however becomes fairly large and unwieldy, since the drill floor, to which the rotary tables of the two systems are attached, will for example be substantially larger than the drill floor of drilling devices with only one rotary table. Further, since the drilling derrick is designed to carry two suspension devices, one for each system, the drilling derrick becomes also substantially larger than the drilling derrick of drilling devices with only one suspension device. Since the drill floor and the drilling derrick are often situated high up in a marine structure, this means, apart from the weight of the marine structure increasing, that the centre of gravity is also moved upwards. This is especially critical for floating marine structures, since this movement of the centre of gravity will in the end lead to a reduced deck load capacity of the structure, which in turn can lead to a deteriorated production capacity.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

The present invention will below be explained by means of non-limiting examples with reference to the appended drawings, wherein.

DETAILED DESCRIPTION

Figure 1:
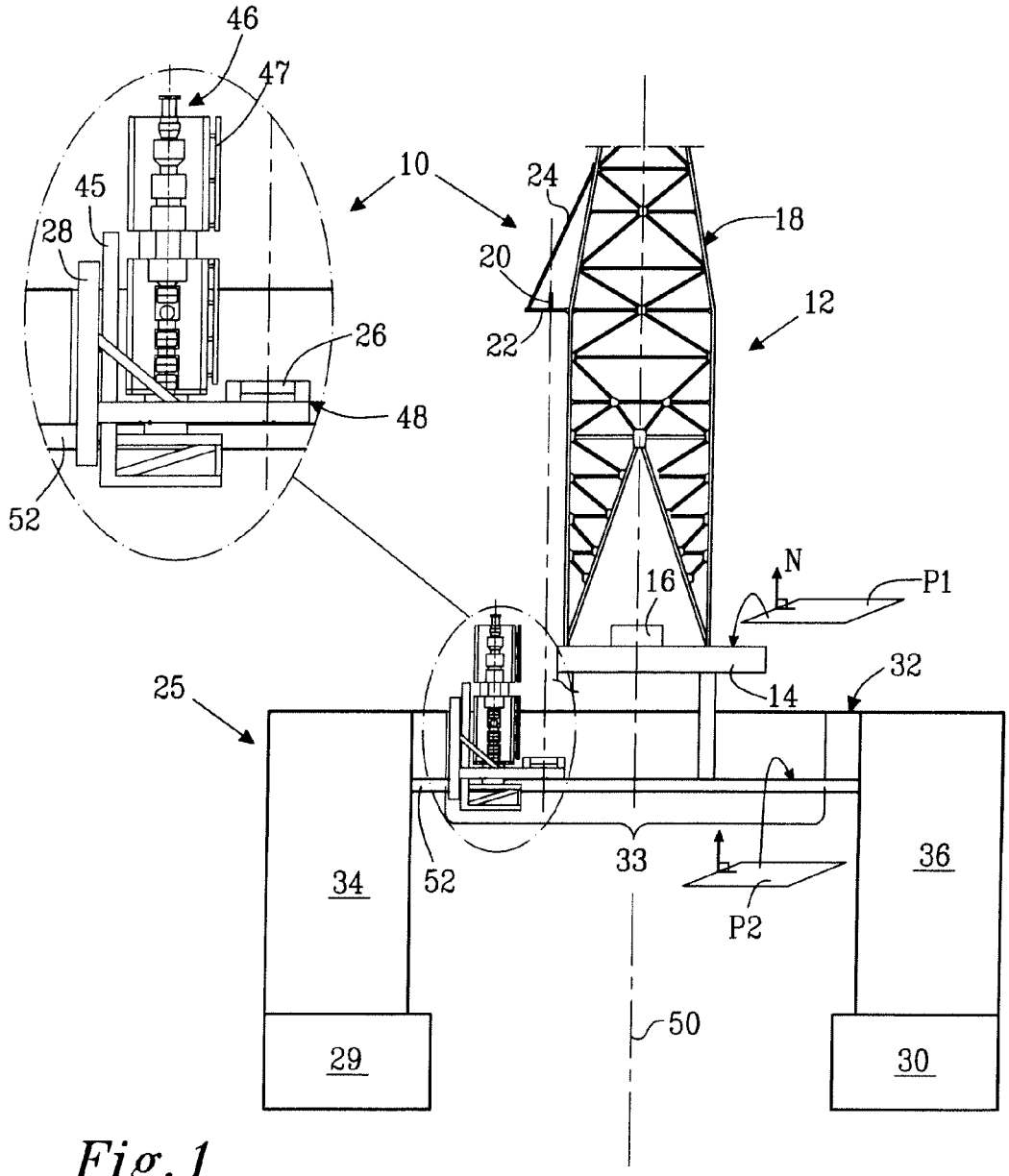
FIG. 1 is a schematic front view of a semi-submersible vessel with a drilling device comprising an embodiment of the system according to the present invention.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

The present invention relates to a system for building and/or handling a tubular string of a drilling device. The drilling device comprises a drill floor and a drilling derrick extending from the drill floor. The drill floor has an extension in a first plane being substantially perpendicular to a first direction. The system comprises a suspension device being fixedly attached to the drilling derrick, wherein a projection of the suspension device, in the first direction, onto the first plane is situated outside the drill floor.

The present invention also relates to a drilling device trolley arranged to transport a component to and from a drilling centre of a drilling device. Further, the present invention relates to a use of a drilling device having a drill floor, wherein the drilling device has a suspension device being situated outside the drill floor. Moreover, the present invention relates to a method of adding a tubular member to a tubular string.

When drilling in the earth crust, e.g. drilling for natural resources in the form of hydrocarbons like natural gas or oil, it is preferred to achieve rapid and safe drilling. Especially when drilling for hydrocarbons off-shore there are high demands for safety, as leakage of for example oil into the sea could have serious consequences. To improve safety when drilling for hydrocarbons, especially when drilling off-shore, a plurality of systems are used today. Drilling is for example often performed by conveying a drill string through a riser, which riser extends from the drilling device, often being situated at the water surface, down to the bottom.

Moreover, drilling below the bottom often occurs through a blow-out preventer, which on one hand can protect the rest of the drilling equipment against pressure spikes which might occur when a gas pocket with high pressure is encountered during drilling, and on the other hand can be arranged to seal the drilling well if the drilling device, which may be situated on a floating structure, for some reason is drifting away from its drilling position. Further, when the drilling of a well has been finished, a valve system—which is often called "Xmas Tree"—is not seldom attached to the drilling hole, to which valve system conduits may be coupled to lead hydrocarbons to one or more production plants. Both the blow-off preventer and the valve system can be attached to the opening at the bottom of the sea and in these cases the component, i.e. either the blow-out preventer or the valve system, is brought down to the bottom by attaching the component to a tubular string at the drilling device, where the length of the string is successively increased, by connecting tubes to each other at the drilling device, until the component has reached the bottom.

From the abovementioned examples, it is realized that, besides the construction of the tubular string itself, a drilling device, especially a drilling device off-shore, is traditionally used to build and/or handle tubular strings, whose purpose is not directly to perform the drilling itself. Since traditional drilling devices often only have one system for building and/or handling tubular strings, comprising a hang-off device for pipes and a rotary table for rotating and/or holding the tubular string, this has led to that the drilling of an oil well taking long time.

To solve this problem, prior art, e.g. EP 0836 668, suggests that a drilling device of a vessel is provided with two systems, each one comprising a suspension device and a rotary table, for building and/or handling tubular strings. Further, EP 0 836 668 discloses that the drilling device can be provided with means for moving tubular strings between the systems. In this way, parallel activities can be performed by the drilling device, which speeds up the total drilling process. The drilling device according to EP 0 836 668 however becomes fairly large and unwieldy, since the drill floor, to which the rotary tables of the two systems are attached, will for example be substantially larger than the drill floor of drilling devices with only one rotary table. Further, since the drilling derrick is designed to carry two suspension devices, one for each system, the drilling derrick becomes also substantially larger than the drilling derrick of drilling devices with only one suspension device. Since the drill floor and the drilling derrick are often situated high up in a marine structure, this means, apart from the weight of the marine structure increasing, that the centre of gravity is also moved upwards. This is especially critical for floating marine structures, since this movement of the centre of gravity will in the end lead to a reduced deck load capacity of the structure, which in turn can lead to a deteriorated production capacity.

A first object of the present invention is to provide a system for a drilling device, wherein the system can be used in addition to a main system of the drilling device for building and/or handling a tubular string, wherein the system can be designed to in the least possible degree detrimentally effect the total weight and/or the centre of gravity of the drilling device.

A second object of the present invention is to provide a system for a drilling device, wherein said system can be used in addition to a main system of the drilling device for building and/or handling a tubular string, wherein the system can be mounted on already existing drilling devices.

A third object of the present invention is to provide a system for a drilling device, wherein said system can be used in addition to a main system of the drilling device for building and/or handling a tubular string, wherein the system can contribute to the preparation of an oil well being performed in a short time.

At least one of the above objects is achieved by a system for building and/or handling a tubular string of a drilling device according to claim 1.

The present invention therefore relates to a system for building and/or handling a tubular string of a drilling device, wherein the drilling device comprises a drill floor and a drilling derrick extending from the drill floor. The drill floor has an extension in a first plane being substantially perpendicular to a first direction. The system comprises a suspension device being fixedly attached to the drilling derrick, wherein a projection of the suspension device, in the first direction, onto the first plane, is situated outside the drill floor.

According to the invention, the system further comprises a hang-off device being located at a distance, in the first direction, from the suspension device, wherein the hang-off device is arranged to for at least part of the time be situated in a working position so that a projection of the hang-off device, in the first direction, onto the first plane is situated outside the drill floor.

As used herein, the expression "hang-off device" relates to a device with which a member can be hung off, i.e. be attached substantially at one end, to thereafter hang down from the device. In connection to the present invention this member often is a tubular string.

According to a preferred embodiment of the invention, the projection of the suspension device coincides with the projection of the hang-off device.

According to yet an embodiment of the invention, the drilling derrick extends from the drill floor in substantially the first direction.

According to another embodiment of the invention, the drilling derrick extends from a first side of the drill floor, wherein the hang-off device is situated at the opposite side of the drill floor.

According to yet an embodiment of the invention the hang-off device is arranged to be moveable in relation to the drill floor.

According to another embodiment of the invention, the hang-off device is arranged to be movable in a second plane being substantially parallel to the first plane.

According to yet an embodiment of the invention, the hang-off device is fixedly attached to a drilling device trolley being movable in the second plane.

A first object of a second aspect of the present invention is to provide a member of a drilling device, which member is used for detachably storing a component of the drilling device, wherein the member can also be used for contributing to the preparation of for example a natural gas or oil well being performed in a short time.

A second object of the second aspect of the present invention is to provide a member of a drilling device, which member is used for detachably storing a component of the drilling device, wherein the member can be designed to in the least possible degree detrimentally influence the total weight and/or the centre of gravity of the drilling device.

At least one of the above objects of the second aspect of the present invention is achieved by a drilling device trolley for detachably storing a component outside a drill floor of a drilling device according to claim 8.

The second aspect of the present invention therefore relates to a drilling device trolley comprising a storage device for detachably storing a component outside a drill floor of a drilling device. The drilling device comprises a drilling centre and the drilling device trolley is arranged to transport the component to and from the drilling centre. In accordance with the second aspect of the invention, the drilling device trolley further comprises an attachment means arranged to attach a hang-off device to the drilling device trolley.

According to a preferred embodiment of the second aspect of the invention, the attachment means is arranged to detachably attach a hang-off device to the drilling device trolley.

According to another embodiment of the second aspect of the invention, the attachment means is arranged to fixedly attach a hang-off device to the drilling device trolley.

According to yet an embodiment of the second aspect of the invention, the drilling device trolley is arranged to be displaced in a second plane relative to the drilling device.

According to yet an embodiment of the second aspect of the invention, the attachment means comprises a displacement member arranged to displace at least a part of the hang-off device in relation to the drilling device trolley in a direction substantially being in the second plane.

According to another embodiment of the second aspect of the invention, the attachment means comprises a pivoting member arranged to pivot at least a part of the hang-off device around an axis.

According to yet an embodiment of the second aspect of the invention, the axis substantially extends in the second plane.

According to another embodiment of the second aspect of the invention, the drilling device trolley comprises a hang-off device attached to the attachment means.

According to yet an embodiment of the second aspect of the invention, the hang-off device comprises an opening extending substantially perpendicular to the second plane and where the opening has an opening centre. The hang-off device comprises two from each other detachable parts which are arranged to be situated at substantially opposite sides of the opening centre.

According to another embodiment of the second aspect of the invention, the component is a blow-out preventer.

A third aspect of the invention relates to a drilling device comprising a drill floor, a drilling derrick extending from the drill floor and a drilling device trolley according to the second aspect of the invention.

In a preferred embodiment of the third aspect of the invention, the drill floor has an extension in a first plane being substantially perpendicular to a first direction. The drilling derrick further comprises a suspension device, wherein a projection of the suspension device, in the first direction, onto the first plane is situated outside the drill floor.

In another embodiment of the third aspect of the invention, the first and second planes are parallel.

A fourth aspect of the invention relates to a marine structure, for example a semi-submersible vessel, comprising a system according to the present invention and/or a drilling device trolley according to the second aspect of the present invention and/or a drilling device according to the third aspect of the present invention.

A fifth aspect of the invention relates to the use of a drilling device, which drilling device comprises a drill floor and a drilling derrick extending from the drill floor. The drill floor has an extension in a first plane being substantially perpendicular to a first direction, wherein the drilling device comprises a suspension means fixedly attached to the drilling derrick. A projection of the suspension device, in the first direction, onto the first plane is situated outside the drill floor. The suspension device is used for building and/or handling a tubular string in cooperation with a hang-off device. The hang-off device is situated at a distance, in the first direction from the suspension device and the hang-off device is, for at least part of the time, situated in a working position so that a projection of the hang-off device, in the first direction onto the first plane is situated outside the drill floor.

In a preferred embodiment of the fifth aspect of the invention, the suspension device is used for building and/or handling a tubular string in cooperation with a movable hang-off device.

In yet an embodiment of the fifth aspect of the invention, the suspension device is used for building and/or handling a tubular string in cooperation with a hang-off device being situated on a drilling device trolley.

A sixth aspect of the invention relates to a method to add a tubular member to a tubular string by means of a drilling device. The drilling device comprises a drill floor and a suspension device. The tubular string is attached to a hang-off device being situated outside the drill floor. The method according to the sixth aspect of the present invention comprises the steps of lifting up the tubular member by means of the suspension device, wherein the tubular member is situated outside the drill floor; attaching the tubular member to the tubular string, wherein an extended tubular string is obtained; detaching the tubular string from the hang-off device; lowering the tubular string by means of the suspension device, and attaching the tubular string to the hang-off device.

In a preferred embodiment of the sixth aspect of the invention, the tubular string has an upper end and the tubular string is attached to the hang-off device at the upper end.

With reference to the figures, FIG. 1 illustrates a system 10 for building and/or handling a tubular string of a drilling device 12. The drilling device 12 comprises a drill floor 14 comprising a rotary table 16, which is only illustrated schematically in FIG. 1. The drill floor 14 has an extension in a first plane P1, which is substantially perpendicular to a first direction N.

The drilling device 12 further comprises a drilling derrick 18 extending from the drill floor 14 in a main direction which is substantially parallel to the first direction N, which is preferred. However, the drilling derrick could also extend in a direction angled in relation to the first direction N. The system 10 comprises a suspension device 20, fixedly attached to the drilling derrick 18, which suspension device 20 is arranged so that a projection of the suspension device 20, in the first direction N, onto the first plane P1, is situated outside the drill floor 14.

FIG. 1 illustrates a preferred attachment arrangement for fixedly attaching the suspension device 20 to the drilling derrick 18, which attachment arrangement comprises a cantilever 22 and a bar 24. The cantilever 22 and the bar 24 are preferably attached to the drilling derrick 18 by means of bolt connections (not shown). The suspension device 20 preferably comprises a crown block, travelling block and a hook (not shown).

In the cases where the system 10 and the drilling device 12 are arranged to be used for drilling at sea or at a lake, the system 10 and the drilling device 12 are preferably arranged on a marine structure, e.g. a semi-submersible vessel 25 as illustrated in FIG. 1. The vessel 25 is constructed in a known way with floats in the form of pontoons 29, 30, a deck structure 32 and a plurality of support columns, of which only two 34, 36 are illustrated in FIG. 1, which attach the deck structure 32 to a respective pontoon 29, 30. The deck structure 32 is preferably provided with a deck opening 33 and the drilling device 12 is preferably positioned above the deck opening 33.

FIG. 1 further illustrates that the system 10 comprises a hang-off device 26 being situated at a distance, in the first direction N, from the suspension device 20. The hang-off device 26 is arranged to be, for at least part of the time, in a working position so that a projection of the hang-off device 26, in the first direction N, onto the first plane is situated outside the drill floor 14. FIG. 1 further illustrates that the projection of the suspension device 20 and the projection of the hang-off device 26 coincide. This position has, in the embodiment illustrated in FIG. 1, been achieved by arranging the hang-off device 26 on a drilling device trolley 28, wherein the drilling device trolley 28 can be moved in a second plane P2 in relation to the drilling device 12 and where the drilling device trolley 28 can be positioned in at least a position being situated outside the drill floor 14. Preferably the first and the second planes P1, P2 are parallel, as illustrated in FIG. 1. However, in certain embodiments of the system 10 according to the invention, the hang-off device 26 could be fixedly attached to the drilling device 12 or in a structure which in turn is fixedly attached to the drilling device 12, e.g. the deck structure 32 as illustrated in FIG. 1. Further, the hang-off device 26 could be movable in relation to the drilling device 12 by means of a lifting crane (not shown).

The hang-off device 26 can be of arbitrary kind, as long as it has capacity to hold a member, preferably a tubular string, extending from the hang-off device 26. The weight of this member can be considerable, above all on the occasions when a further component, like a blow-out preventer, is attached to a tubular string before it is submerged. For example, a rotary table (not shown) could be used as hang-off device 26, even if the hang-off device 26 does not necessarily need to rotate to be able to build and/or handle a tubular string. However, rotary tables for drilling devices have been developed to such a degree that the hang-off capacity, i.e. the magnitude of the load which can be hung off, is so high that a rotary table is suitable to use a hang-off device 26. Preferably, a divisible rotary table is used.

Moreover, it is understood from FIG. 1 that the drilling derrick 18 extends from a first side of the drill floor 14 and that the hang-off device 26, in the embodiment demonstrated in FIG. 1, is situated at the opposite side of the drill floor 14. However, it would be possible that the hang-off device 26 is situated at the same level as, or even at the same side of the drill floor 14 as the drilling derrick 18.

Figure 2:
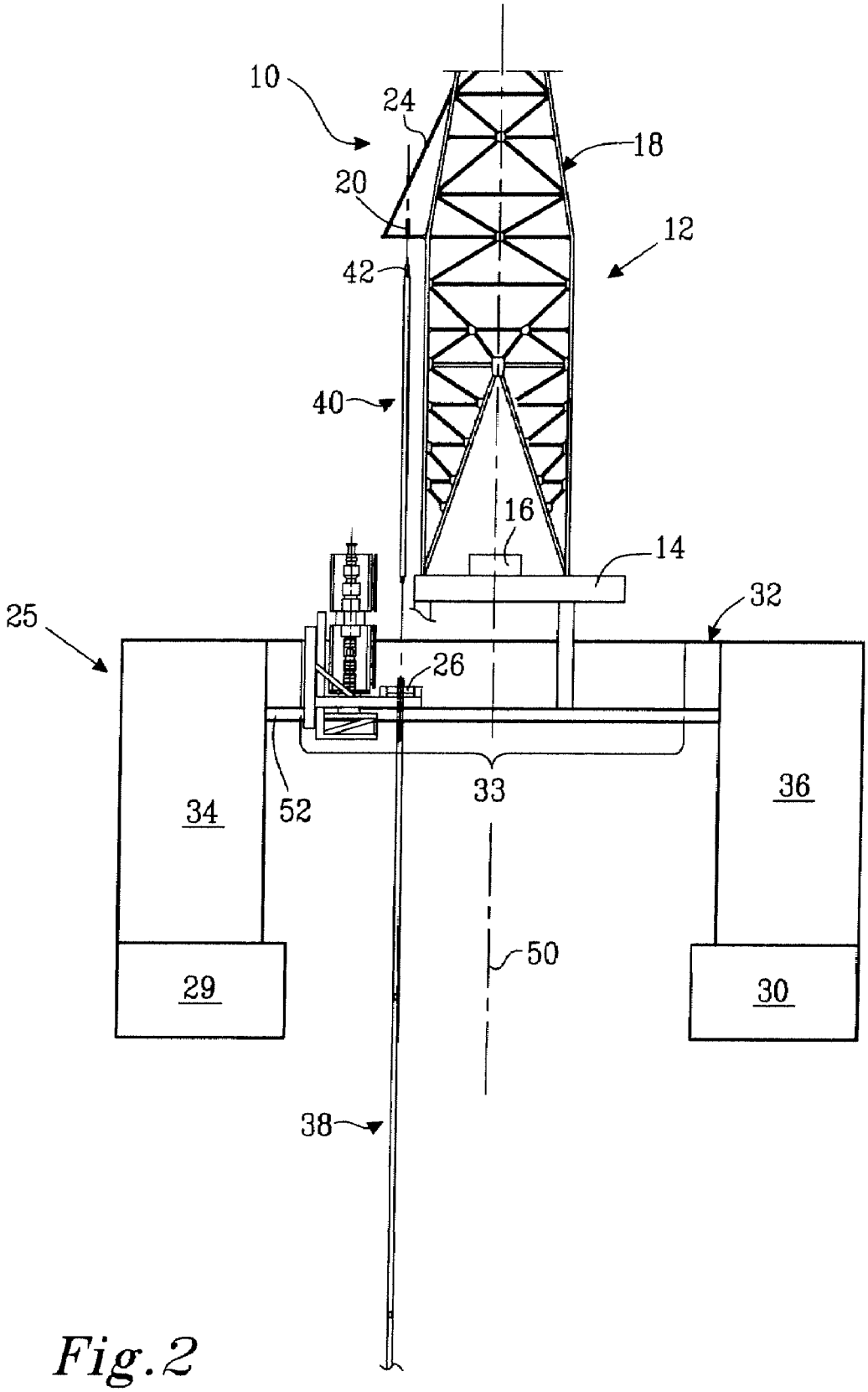
FIG. 2 is the system of FIG. 1, when it is used for building a tubular string.

The system according to the embodiment of the present invention illustrated in FIG. 1 may be used to build and/or to handle a tubular string. This is illustrated schematically in FIG. 2 showing the system 10 according to the present invention when it is used to build a part of a tubular string 38. The string 38 is composed of a plurality of tubes attached to one another, and to continue building the string 38, an additional tube 40 is lifted from a storage (not shown) normally situated beside the drilling device 12 and is attached to the hook 42 of the suspension device 20. At the same time the hitherto built-up string 38 is held by the hang-off device 26. The hook 42 is then lowered until the lower end of the additional tube 40 contacts the upper tube of the string 38, wherein the tube 40 thereafter is attached to the string 38. This attachment can be achieved in a plurality of ways, e.g. by means of each tube being a part of the string being provided with threads (not shown), wherein the tube 40 is screwed onto the string 38, or by means of the tubes being attached to each other by means of flange joints (not shown).

As earlier mentioned, the hang-off device 26 can be arranged to, for at least part of the time, be situated outside the drill floor 14 in many ways. FIG. 1 illustrates, however, a preferred way, which comprises a drilling device trolley 28 comprising a storage device 45 for detachably storing a component 46 outside the drill floor 14 of the drilling device 12. As illustrated in FIG. 1, the illustrated embodiment of the storage device 45 is arranged to store the component 46 in a position implying that the component 46 is situated at the same level as the drilling device trolley 28 when it is stored thereon, i.e. the component 46 has an upper section 47 which is situated above a lowermost section of the drilling device trolley 28. The storage device 45 can be designed in a plurality of different ways, one of which is illustrated in FIG. 1, where it comprises a cantilever which is vertically adjustable in relation to the drilling device trolley 28.

The drilling device trolley 28 further comprises an attachment means 48, which is only schematically illustrated in FIG. 1, arranged to attach the hang-off device 26 to the drilling device trolley 28. Preferably the attachment means 48 is arranged to attach the hang-off device 26 on top of a section of the drilling device trolley 28. The drilling device trolley 28 is arranged to transport the component 46 to and from a drilling centre 50 of the drilling device 12. In the example illustrated in FIG. 1, the component 46 is a blow-out preventer, but the component could also be for example a valve system—"Xmas tree"—or any other component needed to be transported to and from the drilling centre 50. In FIG. 1 the drilling device trolley 28 is arranged to move the component 46 to and from the drilling centre by displacing the drilling device trolley 28 in the second plane P2 relative to the drilling device 12. Preferably, the drilling device trolley 28 is displaceable by being arranged on rails (not shown) on the vessel 25, which rails are preferably situated below the drill floor 14, for example on a lower deck 52 of the vessel 25.

Figure 3:
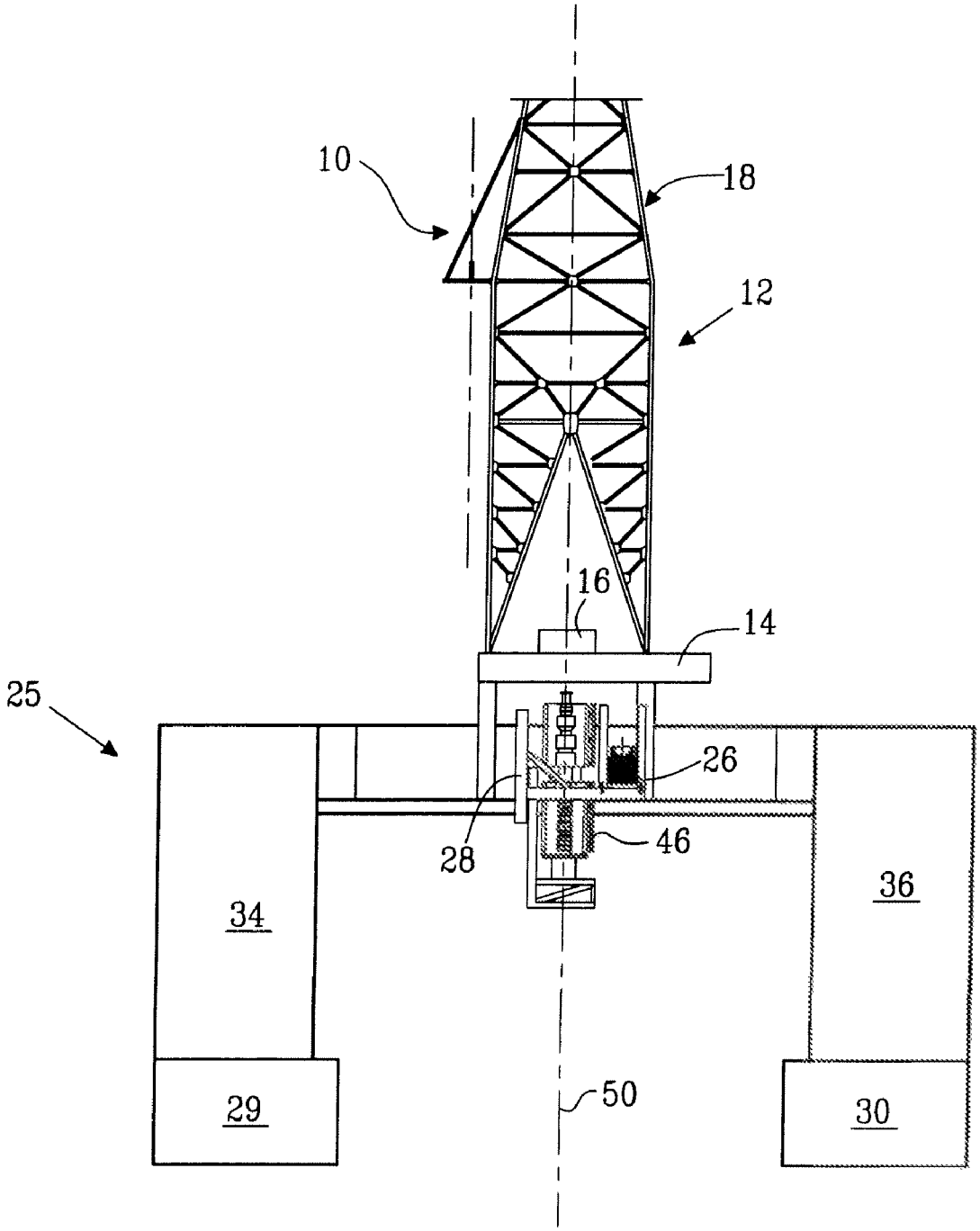
FIG. 3 is a schematic front view of the vessel of FIG. 1, where a part of the system according to the present invention is in another position than in FIG. 1.

FIG. 3 illustrates the drilling device trolley 26 in a position when the component 46 being stored on the drilling device trolley 28 is situated in the drilling centre 50. When the component 46 is in this position, it can then be attached to a tubular string (not shown) being built up by the drilling device 12. The drilling device trolley 28 can thereafter release the component 46 and this can then be submerged in the water by extending the tubular string by adding additional tubes until the component has reached a desired distance from the drilling device. In the case, where the component 46 is a blow-out preventer arranged to sit on the bottom, the tubular string is built up until the blow-out preventer reaches the bottom.

By arranging the attachment means 48 on the drilling device trolley 26 a drilling device trolley for many purposes is achieved, like detachably storing the component 46, transporting the component 46 to and from the drilling centre 50 and, as well, carry the hang-off device 26, which can be used for building and/or handling a tubular string (not shown in FIG. 1).

In the position of the drilling device trolley 28 illustrated in FIG. 1, the drilling device trolley 28 can store the component 46, at the same time as the hang-off device 26, which is attached to the drilling device trolley 28 by means of the attachment means 48, can be used for building and/or handling a tubular string in cooperation with the suspension device 20. The attachment means 48 in FIG. 1 is arranged to fixedly attach the hang-off device 26 to the drilling device trolley 28, but in other embodiments of the invention, the attachment means 48 could be arranged to detachably attach the hang-off device 26 to the drilling device trolley 28. It is however preferred that the hang-off device 26 is displaceable from the position showed in FIG. 1 either by means of rotating, displacing or even lifting away the hang-off device 26 from the illustrated position, to facilitate lifting the component 46 to and from the storage device 45.

Figure 4:
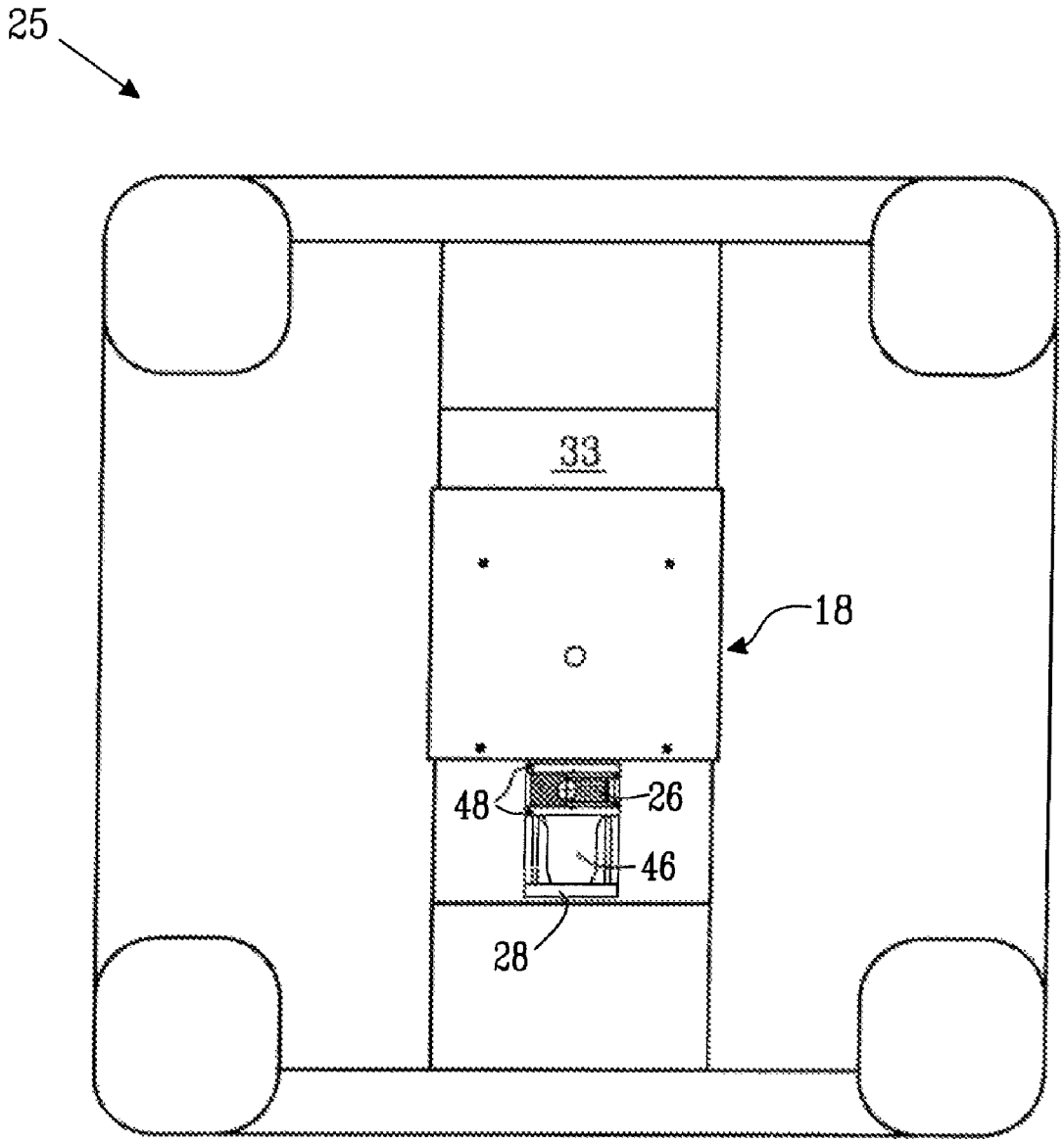
FIG. 4 is a schematic top view of the vessel of FIG. 1.

FIG. 4 illustrates a top view of the embodiment of FIG. 1 of the drilling device trolley 28 according to the second aspect of the present invention.

Figure 5:
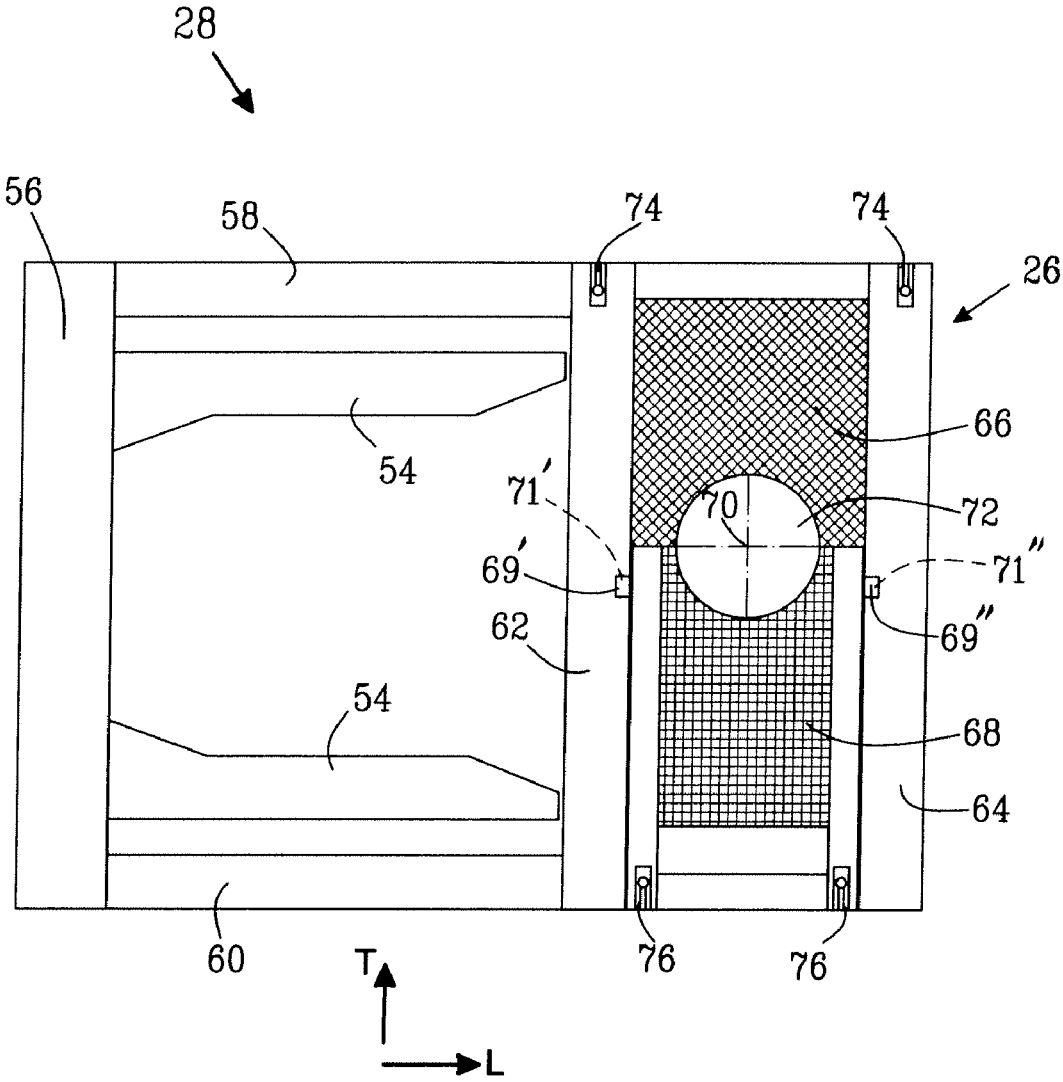
FIG. 5 is a schematic top view of an embodiment of a drilling device trolley according to the second aspect of the present invention.

FIG. 5 illustrates a preferred embodiment of the drilling device trolley 28 according to the second aspect of the present invention. The drilling device trolley 28 comprises cantilevers 54 extending from a base plate 56 to detachably store a component outside a drill floor 14 of a drilling device 12. The cantilevers 54 thus, in the embodiment illustrated in FIG. 5, constitute the storage device 45. Moreover, the drilling device trolley 28 comprises two beams 58, 60 extending in a longitudinal direction L and to which the base plate 56 is attached. The drilling device trolley 28 further comprises a hang-off device 26. In certain embodiments of the drilling device trolley 28 according to the second aspect of the present invention, the cantilevers might be fixedly attached to the beams 58, 60.

The hang-off device 26 illustrated in FIG. 5 comprises two transversal beams 62, 64 extending between the longitudinal extending beams 58, 60. To the transversal beams 62, 64 are attached two hang-off members 66, 68 being situated on either side of the opening centre 70 of an opening being formed between the two hang-off members 66, 68. In the embodiment of the hang-off device 26 illustrated in FIG. 5, one of the hang-off members 66 is fixedly attached to the transversal beams 62, 64, while the other hang-off member 68 is detachably attached to the same via pins 69', 69" being arranged to rest against the two transversal beams 62, 64.

In the implementation of the hang-off device 26 illustrated in FIG. 5, unloading of for example tubular strings can take place by arranging an extending part of the string, for example a flange or a carrier (not shown), to rest against the edges of the parts 66, 68 at the opening 72. However, the hang-off device 26 could also comprise means (not shown) for clamping the string at the opening 72. Alternatively, the opening 72 could be shaped so that it, throughout its extension, has a frustaconical shape (not shown), arranged to receive a flange or carrier (not shown) having the corresponding shape.

Further, as earlier mentioned, the hang-off device 26 could comprise means for rotating the string around its longitudinal axis. In this case, the hang-off device 26 would be reminiscent of, or even may be constituted by, a rotary table.

The hang-off device 26 is preferably movable relative to the drilling device trolley 28 to for example facilitate that the drilling device trolley 28 is moved after a component 46 has been lowered from the storage device by means of a tubular string. As above indicated, this movability can be achieved by arranging the hang-off device 26 detachably attached to the drilling device trolley 28. Alternatively, the two hang-off members 66, 68 could be arranged to be displaceable from the opening centre 70 in transversal direction. However, FIG. 6 illustrates a preferred embodiment of the hang-off device in which it is movable relative to the drilling device trolley 28.

Figure 6:
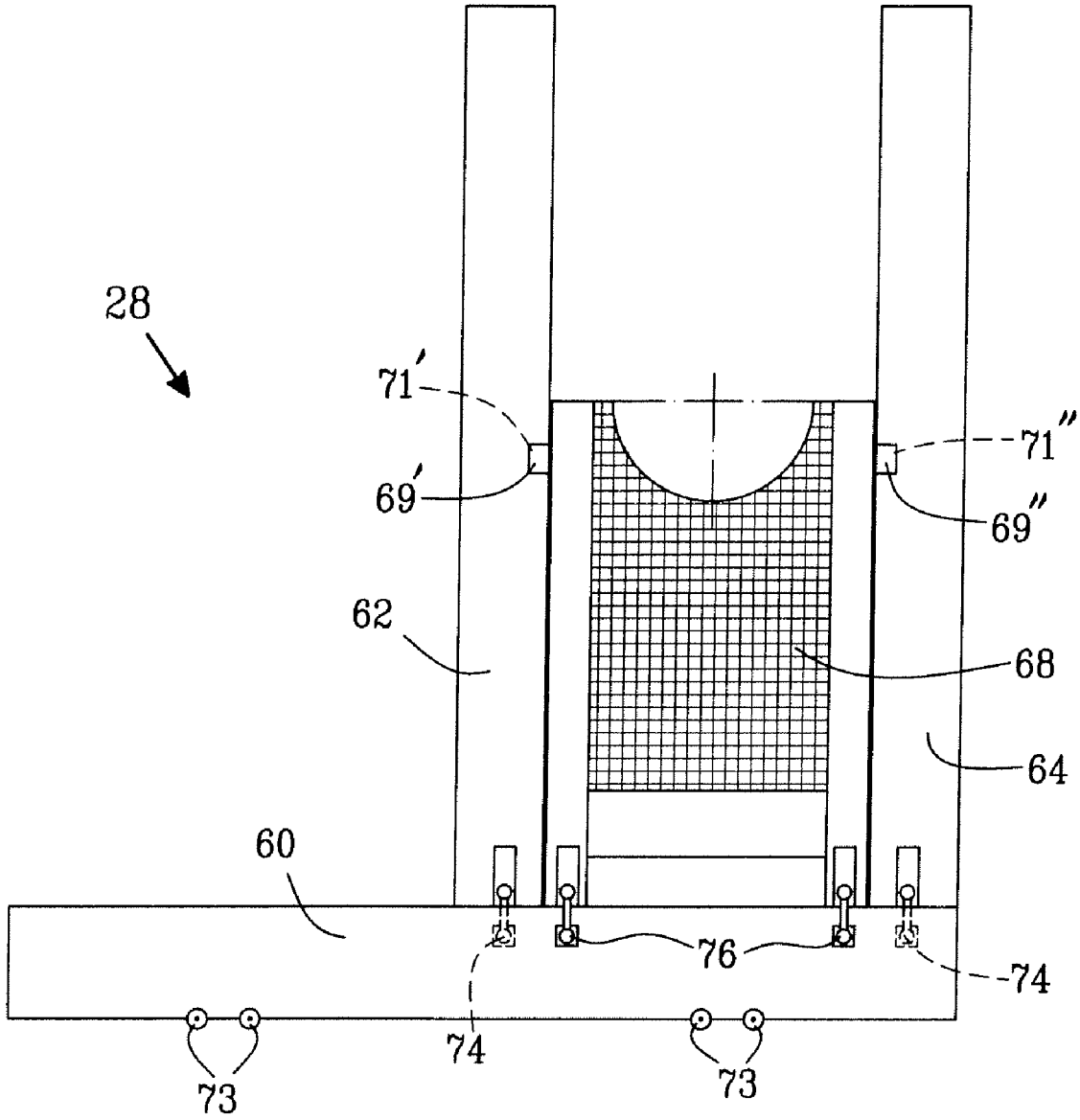
FIG. 6 is a schematic side view of the drilling device trolley of FIG. 5.

FIG. 6 illustrates the hang-off device 26 of the embodiment of FIG. 5 in a raised position. To reach this position, the attachment means comprise a pivoting member arranged to pivot at least part of the hang-off device 26 around an axis. In the embodiment illustrated in FIGS. 5 and 6, the attachment means comprises pivoting members 74, e.g. hinges, which pivotally attach the transversal beams 62, 64 and/or one of the hang-off members 66 with one 58 of the longitudinally extending beams. Moreover, the attachment means comprise a further pivoting member 76, which pivotally attaches the other hang-off member 66 with the other 60 of the longitudinal beams. Preferably the drilling device trolley according to this embodiment also comprises a drive system, e.g. a hydraulic system (not shown), to achieve the pivoting of the beams 62, 64 and the hang-off members 66, 68. It is further illustrated in FIG. 6 that each one of the transversal beams 62, 64 can be provided with a recess 71', 71" to receive the pins 69', 69". Moreover, FIG. 6 illustrates that the drilling device trolley 28 is provided with a plurality of wheels 73 which is arranged to move on rails (not shown) of the drilling device (not shown) and/or a structure on which the drilling device rests (not shown).

Figure 7:
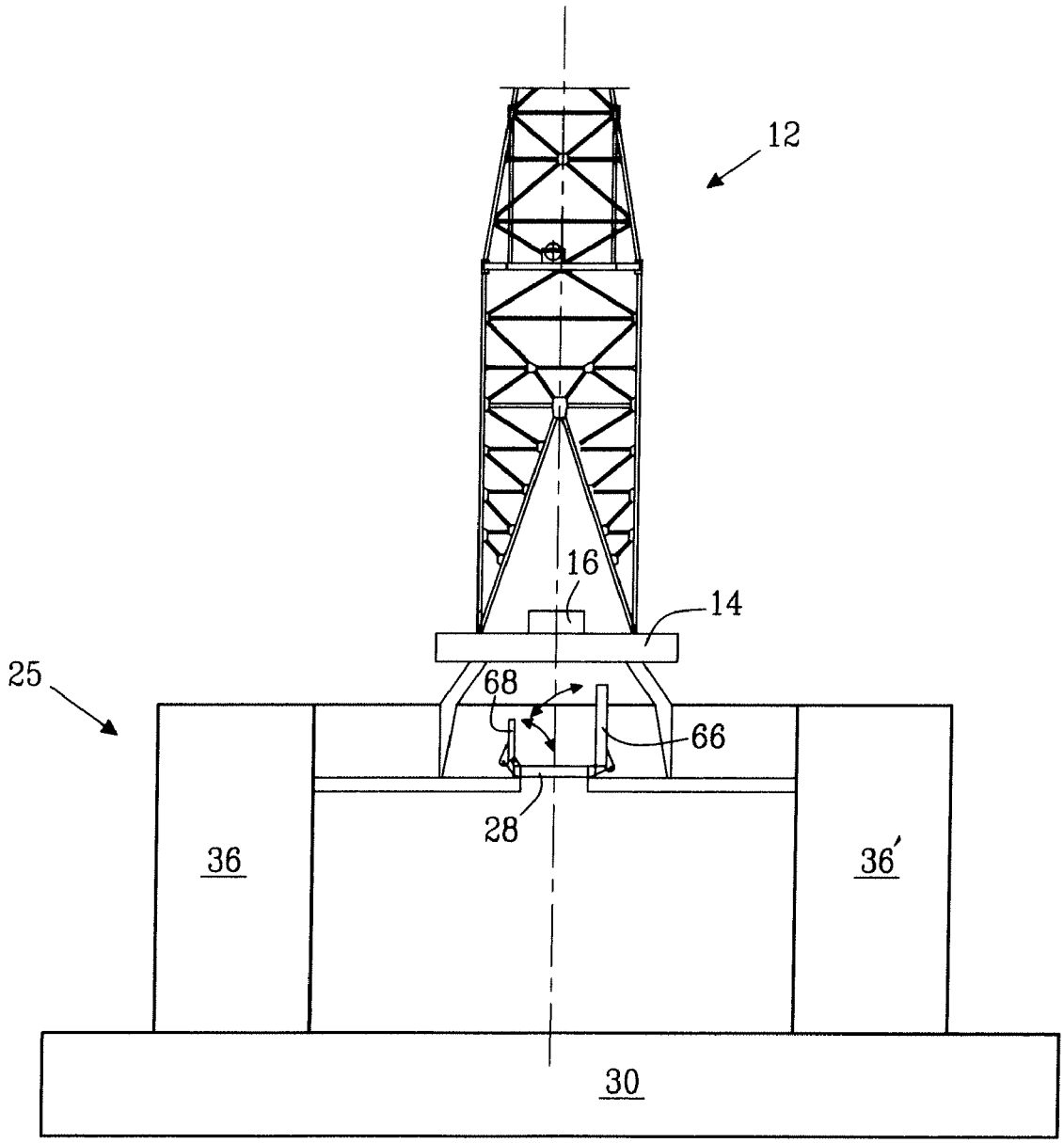
FIG. 7 is a schematic side view of the drilling device trolley of FIG. 5, where the hang-off device is in a raised position.
Figure 8:
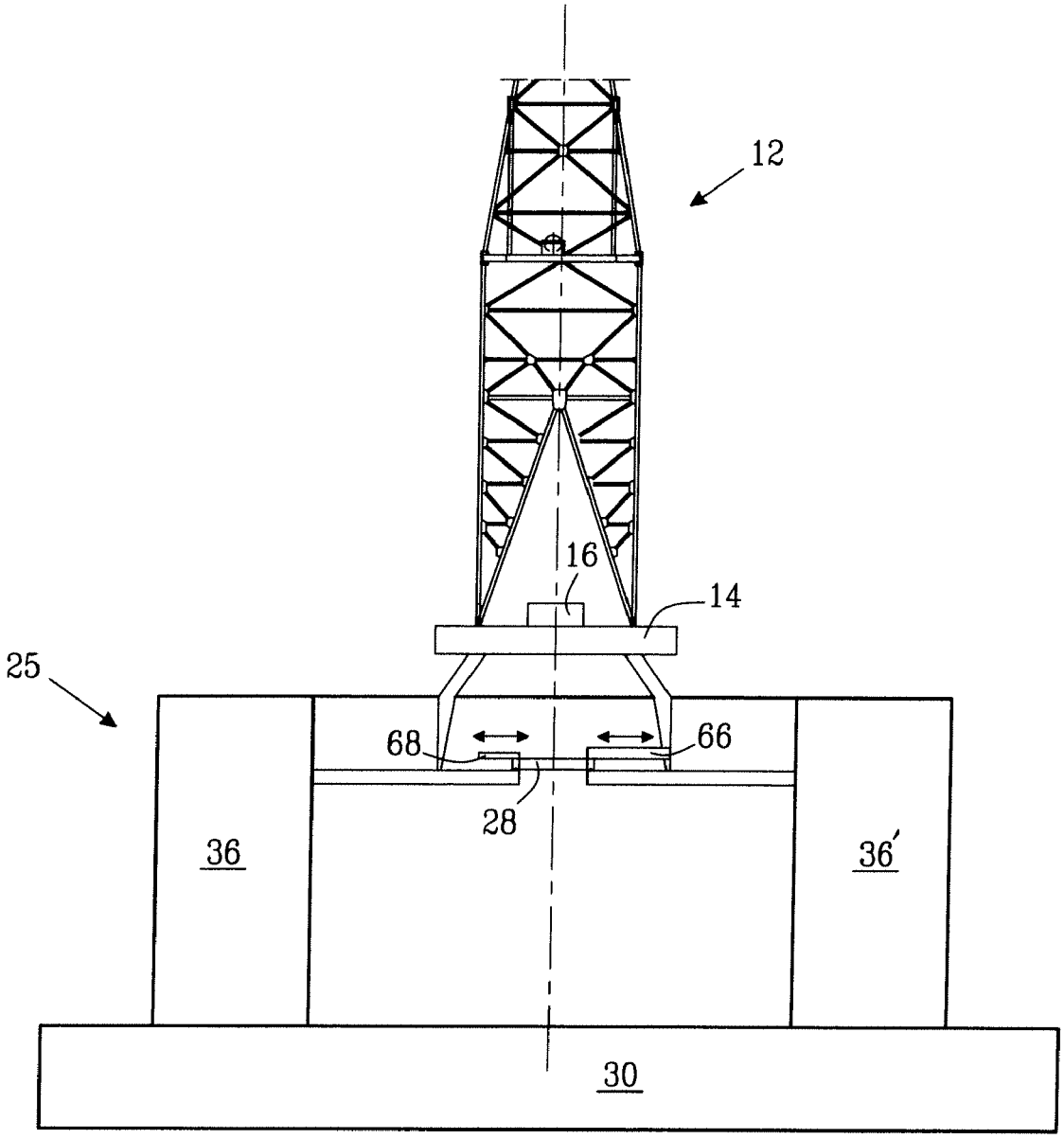
FIG. 8 is a schematic side view of the drilling device trolley of FIG. 5, where the hang-off device is in a sideways displaced position.

FIGS. 7 and 8 illustrate a side view of the drilling device trolley 28 when it is on a vessel 25. FIG. 7 illustrates how the hang-off members 66, 68 have been pivoted as to be arranged substantially perpendicular to the longitudinal extension of the drilling device trolley 28, while FIG. 8 illustrates the hang-off members 66, 68 in a position when they are displaced sideways and are substantially parallel to the longitudinal extension of the drilling device trolley 28, but outside the drilling device trolley 28. FIG. 7 thus illustrates an embodiment of the drilling device trolley 28, where the attachment means 48 comprises two pivoting members to pivot the hang-off members 66, 68, while FIG. 8 illustrates an embodiment of the drilling device trolley 28, where the attachment means 48 comprises two displacement members to displace the hang-off members 66, 68 sideways.

Figure 9:
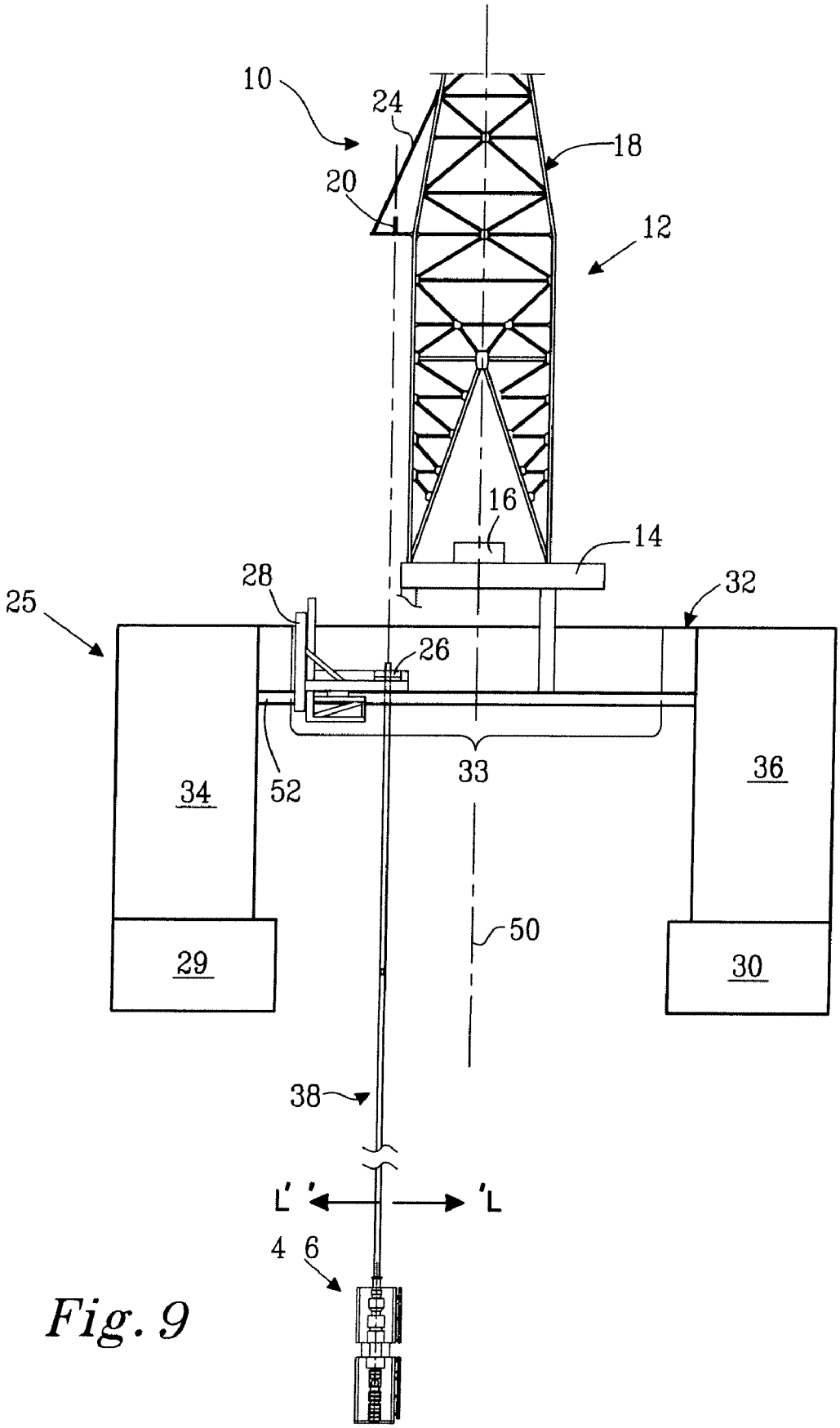
FIG. 9 is a schematic side view of the embodiment illustrated in FIG. 1, where the hang-off device is used to move a tubular string.

Finally, FIG. 9 illustrates how the drilling device trolley 28 according to second aspect of the present invention can be used for other purposes than to build up a tubular string. In other words, in FIG. 9 an example is illustrated of how the drilling device trolley 28 can be used to handle a tubular string. In the embodiment illustrated in FIG. 9, a component 46, in this case a blow-out preventer, has been detached from the drilling device trolley 28 and submerged into the water below the drilling device 12 by means of a tubular string 38, which in this case is a riser being built up by the drilling device 12. The tubular string 38 and the component 46 are normally positioned in the drilling centre 50, whereafter drilling is performed by means of a drill string (not shown) which is conducted through the riser and the blow-out preventer. When the drilling has been finished, the drill string is lifted through the riser. Traditionally, the riser and the blow-out preventer are thereafter lifted before the vessel 25, on which the drilling device 12 is situated, is moved to a new position to perform a new drilling. However, by means of the drilling device trolley 28, the tubular string 38 could instead be attached to the hang-off device 26 of the drilling device trolley 28 and the tubular string 38, then having the component 46 attached to its lower end, could then be displaced sideways, i.e. in the direction of L". Preferably the tubular string 38 is lifted up in one piece, for example 10-15 meters before the movement occurs to ensure that the component 46 does not hit the bottom during the movement. Thereafter, the vessel 25 could be moved to a new drilling position, wherein the drilling device 12 is used to prepare a new position at the bottom for the component 46. When this preparation is ready, the tubular string 38 can then be moved back to the drilling centre 50 in the direction of L' and thereafter the component 46 can be attached to the bottom. This procedure implies a considerable saving of time compared to earlier known technology, as the steps of both lifting up and thereafter again rebuilding the tubular string can be omitted.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A system for building and handling a tubular string of a drilling device, wherein said drilling device comprises a drill floor and a drilling derrick extending from said drill floor, wherein said drill floor has an extension in a first plane being substantially perpendicular to a first direction, said system comprising a suspension device being fixedly attached to said drilling derrick, wherein a projection of said suspension device in said first direction onto said first plane is situated outside said drill floor, wherein said drilling device comprises a drilling centre and a drilling device trolley is arranged to transport a component to and from said drilling centre, characterized in that said drilling device trolley further comprises an attachment means arranged to attach a hang-off device to said drilling device trolley, said hang-off device being situated at a distance in the said first direction from said suspension device, wherein said hang-off device is arranged to, for at least part of the time, be in a working position, so that a projection of said hang-off device, in said first direction onto said first plane is situated outside said drill floor, and wherein said hang-off device comprises two from each other detachable parts which are arranged to be situated at substantially opposite sides of an opening centre.

2. The system of claim 1, wherein said projection of said suspension device coincides with said projection of said hang-off device.

3. The system of claim 1, wherein said drilling derrick extends from said drill floor in substantially said first direction.

4. The system of claim 1, wherein said drilling derrick extends from a first side of said drill floor, wherein said hang-off device is situated at the opposite side of said drill floor.

5. The system of claim 1, wherein said hang-off device is arranged to be movable in relation to said drill floor.

6. The system of claim 5, wherein said hang-off device is arranged to be movable in a second plane being substantially parallel to said first plane.

7. The system of claim 5, wherein said hang-off device is fixedly attached to a drilling device trolley being movable in said second plane.

8. The system of claim 1, wherein said attachment means is arranged to detachably attach said hang-off device to said drilling device trolley.

9. The system of claim 1, wherein said attachment means is arranged to fixedly attach said hang-off device to said drilling device trolley.

10. The system of claim 1, wherein said drilling device trolley is arranged to be displaced in a second plane relative to said drilling device.

11. The system of claim 10, wherein said attachment means comprises a displacement member arranged to displace at least a part of said hang-off device in relation to said drilling device trolley in a direction substantially being in said second plane.

12. The system of claim 10, wherein said attachment means comprises a pivoting member arranged to pivot at least a part of said hang-off device around an axis.

13. The system of claim 12, wherein said axis substantially extends in said second plane.

14. The system of claim 1, wherein said drilling device trolley further comprises said hang-off device attached to said attachment means.

15. The system of claim 1, wherein said component is a blow-out preventer.

* * * * *